United States Patent [19]

Aoyama et al.

[11] 4,384,011

[45] May 17, 1983

[54] PROCESS FOR PRODUCING GRAVURE PRINTING PLATES

[75] Inventors: Toshimi Aoyama; Bonpei Kato, both of Yokohama; Hiroyuki Tohda, Fujisawa; Eiichi Tachibana, Toda; Shinichi Hikosaka, Tokyo, all of Japan

[73] Assignees: Dai Nippon Insatsu Kabushiki Kaisha; Tokyo Ohka Kogyo Kabushiki Kaisha, both of Japan

[21] Appl. No.: 302,237

[22] Filed: Sep. 14, 1981

[30] Foreign Application Priority Data

Sep. 19, 1980 [JP] Japan ..... 55-130198

[51] Int. Cl.[3] ..... B05D 3/06

[52] U.S. Cl. ..... 427/54.1; 101/150; 101/153; 204/159.19; 430/283; 430/306; 430/307; 525/526

[58] Field of Search ..... 427/44, 54.1; 101/150, 101/153; 204/159.19; 118/409; 430/283, 306, 307; 525/526

[56] References Cited

U.S. PATENT DOCUMENTS

| | | | |
|---|---|---|---|
| 1,182,982 | 5/1916 | Crump | 118/409 |
| 3,512,971 | 5/1970 | Floss et al. | 430/306 |
| 3,551,148 | 12/1970 | Faulhaber et al. | 430/283 |
| 3,656,999 | 4/1972 | Lundsager | 427/44 |
| 3,764,501 | 10/1973 | Hori et al. | 525/426 |
| 3,985,953 | 10/1976 | Dunkley | 101/150 |
| 4,007,680 | 2/1977 | Pfleger et al. | 101/153 |
| 4,269,930 | 5/1981 | Kress | 204/159.19 |
| 4,339,472 | 7/1982 | Tachibana et al. | 427/44 |

*Primary Examiner*—John H. Newsome

*Attorney, Agent, or Firm*—Parkhurst & Oliff

[57] ABSTRACT

A process for producing novel resinous gravure printing plates comprises coating on a printing substrate such as a cylinder a radiation-curable resin coating composition containing in a specific ratio a soluble polyamide resin and a radiation-polymerizable monomer or the like dissolved in a solvent, curing the coated film by irradiation with actinic rays, and engraving the resulting cured film. As a result, a novel resinous gravure printing plate having excellent engraving property, printing durability, and solvent resistance is produced.

9 Claims, No Drawings

PROCESS FOR PRODUCING GRAVURE PRINTING PLATES

BACKGROUND OF THE INVENTION

This invention relates to a process for producing resinous gravure printing plates which have excellent engraving property or quality, printing durability and solvent resistance.

The processes for producing conventional metal gravure printing plates have required high degrees of skills in electroplating and etching using carbon tissue and also have involved pollution problems. To avoid such difficulties in the conventional processes, resinous gravure printing plates the surfaces of which are composed of resins have been proposed. For example, Japanese Laid-open Patent Applications Nos. 8001/1979 and 22208/1979 disclose processes for forming resinous gravure cells, which comprise coating resins on generally cylindrical substrates to produce printing plate blanks and then engraving the coated resins by an electronic engraver or the like. The resin coating can be applied, for example, by blade-coating wherein solutions of such resins as vinyl chloride resins, ABS resins and polyamide resins are used, or by extrusion or powder-coating wherein the thermoplastic property of resins is utilized.

These conventional processes for producing resinous gravure printing plates, however, are not always satisfactory in connection with the process of forming the resin-coating on the printing subrates to give resin plate blanks and the subsequent mechanical processing. More specifically, the blade coating or the like process utilizes the soluble property of resins, and thus the resulting printing plates have poor resistance to the solvents contained in gravure inks. The extrusion or powder coating process requires a considerably large-scale apparatus and fails to produce such smooth resin surfaces as are required for gravure printing plates. Thus, a surface-smoothing treatment by a super-precision lathe or the like is required after the formation, which results in poor productivity.

Moreover, the above-mentioned resins have low resistance to damage by any processing method, and thus the resulting printing plates lack printing durability. In the course of printing, flaws are apt to be produced on the printing plates by abrasion caused by doctor blades, impurities contained in inks, paper dust, and the like. Thus, almost all of the resulting printing plates are damaged in printing 10 thousand meters or less, and it is difficult to apply these plates to the printing of a large lot of 100 thousand meters or more.

Doctor blades composed of resins have been proposed to overcome such low printing durability. Resinous doctor blades are not practicable because they are inferior in the precision of their blade edges, processability of their blade edges, ink-scraping property, and the like.

Moreover, the above-mentioned resin blanks are inferior in engraving property which is very important for gravure plate blanks. Upon engraving cells on the blanks with a stylus in accordance with copy patterns, burrs and chips are apt to be produced on the peripheries of the cells. The burrs result in printing stains and thus are generally rubbed off with a blade called a burr cutter. However, such rubbing-off operations using burr cutters often fail to remove the burrs completely, and sometimes even push the burrs into the cells.

Accordingly, it is desirable that the resins for gravure printing plates have such engraving property that satisfactory cells are produced without forming burrs and chips and that no burr-cutter processing is required. As described above, the resin blanks used in the conventional processes are not always satisfactory also from the viewpoint of engraving property.

A research group to which we belong has previously proposed an improved process to overcome the above described difficulties in the production of the conventional resin gravure printing plates (cf. Japanese Patent Application No. 95734/1979). In this previously proposed process, a photocurable polyamide resin solution, which is used as a photocurable resin suitable for coating by the knife-coater method and the like, is coated on a cylindrical substrate and cured by irradiation with actinic rays and then gravure cells are formed on the cured film by engraving to produce a resinous gravure printing cylinder.

The present invention is concerned with a further improvement of the above-mentioned process. As a result of our further research, it has been found that the composition of the photocurable polyamide resin solution and especially the ratio of the quantities of the polyamide resin and the polymerizable component such as a photopolymerizable monomeric compound are very important for imparting, to the resulting cured coated film, excellent properties and especially a harmonious balance between engraving property and damage resistance for withstanding abrasion by a doctor blade or the like, although these engraving property and damage resistance seem to conflict with each other. In order to balance the engraving property and the damage resistance, it is especially important that the cured coated film have an ultimate tensile elongation (JIS K 6301) of 100% or less and a tensile strength (JIS K 6301) of 100 $Kg/cm^2$ or more. This can be achieved only when the quantity of the polyamide resin and that of the polymerizable component such as a photopolymerizable monomeric compound are within the range of restricted ratios. The process for producing gravure printing plates of the present invention is based on these findings.

SUMMARY OF THE INVENTION

The present invention is characterized by the steps of coating a printing plate substrate with a film of a radiation-curable resin coating composition comprising 100 parts by weight of a soluble polyamide resin, 40 to 120 parts by weight of a radiation-curable monomeric compound and a suitable quantity of a solvent, curing the coated film by irradiation with actinic rays, and then engraving the resulting cured coated film.

The nature, utility, and further features of this invention will be more clearly apparent from the following detail description beginning with a consideration of general aspects of the invention and concluding with specific examples of practice thereof.

The terms "%" and "part" used hereinafter are by weight unless otherwise specified.

DETAILED DESCRIPTION OF THE INVENTION

The radiation-curable resin coating compositions to be used in the present invention include both the photocurable (ultraviolet ray-curable) type and electron-beam curable type compositions. The following description will be concerned principally with photocurable resin coating compositions.

A photocurable resin coating composition according to this invention contains as essential components a soluble polyamide, a photocurable monomeric compound, a solvent, and a photopolymerization initiator. By "soluble polyamide" is meant a polyamide which is compatible with the under-mentioned photopolymerizable monomeric compounds and also with solvents. Soluble polyamides suitable for use in the present invention include modified polyamides obtained by modifying linear polyamides such as 6-nylon, 6,6-nylon, 6,10-nylon and 6,12-nylon, for example, by N-oxymethylation, N-alkyloxymethylation or introduction as their terminal groups or branch groups of sulfonate, carboxyl, thiol or quarternary ammonium groups; copolymeric polyamides of these linear polyamides; condensates of these linear amides with other components such as 4,4'-diamino-dicyclohexylmethane diadipamide; and polyamides having triazine nuclei and piperazine rings. Preferably used are polyamides soluble especially in lower alcohols such as methanol and ethanol. Water-soluble polyamides can also be used in the present invention.

The photocurable monomeric compounds include a monomer, an oligomer thereof and a low-molecular condensate or prepolymer, each having at least one $CH_2{=}C<$ group, which can be photopolymerized in the presence of a photopolymerization initiator described hereinafter to insolubilize the above-mentioned soluble polyamides.

The photocurable monomeric compounds include, for example, various unsaturated monomers, prepolymers and polymerizable oligomers thereof. Examples of the unsaturated monomers are monounsaturated monomers such as acrylic acid, methacrylic acid, acrylamide, methacrylamide, styrene, methyl acrylate, butyl acrylate, diacetoneacrylamide, N-methylolacrylamide, and N-methylolmethacrylamide; polyunsaturated amides such as N,N'-methylenebisacrylamide, N,N'-hexamethylenebisacrylamide, N,N'-(p-phenylene)bisacrylamide, N,N'-(p-phenylene)bismethacrylamide, and N,N'(m-phenylene)bisacrylamide; and polyunsaturated nitrogen-containing monomers such as triacrylformal (i.e., 1,3,5-triacryloyl-hexahydro-1,3,5-triazine); as well as condensed monomers or prepolymers, for example, polyunsaturated esters such as di- or poly-acrylates or methacrylates of di- or poly-hydroxyl compounds such as ethylene glycol, diethylene glycol, triethylene glycol, glycerine, pentaerythritol, 1,2,4-butane-triol, sucrose and sorbit, or condensates of N,N'-dimethylolurea dimethyl ether with N-methylolacrylamide. These photopolymerizable monomeric compounds can be used alone or in combination of two or more thereof. It is preferred, however, from the viewpoint of the properties of curing and coated films after curing that not less than 10% and especially not less than 50% of the monomeric compounds contain at least two, more preferably at least three, $CH_2{=}C<$ groups (ethylenic unsaturations). Moreover, 50% or more of the photopolymerizable monomeric compounds is preferably a nitrogen-containing compound in order to enhance its compatibility with the polyamide.

These photopolymerizable monomeric compounds should be used in the range of 40 parts to 120 parts per 100 parts of the polyamide. The range of 50 to 100 parts is especially preferred per 100 parts of the polyamide. When the quantity of the photopolymerizable monomeric compounds is less than 40 parts, the engraving property of coated films after curing is inferior and conspicuous burrs are formed. When the quantity of the monomeric compounds is far smaller, it becomes impossible to engrave the resulting coated film because of its rubber-like elasticity. Moreover, the printing durability is lowered because of inferior solvent resistance, and the polishing characteristic also becomes worse. On the other hand, when the quantity of the monomeric compound exceeds 120 parts, the damage resistance of the printing plate surface and mechanical strength characteristics such as ultimate tensile strength and elongation are lowered, whereby printing durability also deteriorates.

The photocurable resin coating composition, in addition to the soluble polyamide and photopolymerizable monomeric compound, is admixed with, relative to the total quantity of these two components, generally 0.01 to 10% and preferably 0.05 to 5% of a photopolymerization initiator. The photopolymerization initiators to be used include, for example, benzophenone, 4,4'-dimethylbenzophenone, 4,4'-dimethoxybenzophenone, 4-chlorobenzophenone, 4,4'-dichlorobenzophenone, benzoin, benzoin methyl ether, benzoin ethyl ether, anthraquinone, β-methylanthraquinone, β-tert-butylanthraquinone, acetophenone, benzil, benzyl dimethyl ketal and the like.

A thermal-polymerization inhibitor can be added if desired to improve the storage stability of the photocurable coating composition. As thermal-polymerization inhibitors, hydroquinone, pyrogallol, methylene blue, phenol, p-n-butylphenol, tin chloride, copper chloride and the like can be used. The thermal-polymerization inhibitor is used preferably in a range of 0.001 to 5% of the photocurable coating composition.

If desired, the photocurable coating composition can further contain as optional components, coloring agents such as dyes and pigments, inorganic fillers such as silica and glass powder; plasticizers as generally used for polyamide resins; resins such as polyesters and polyurethanes having good compatibility with polyamide resins, and the like. The total quantity of such optional components is preferably up to 20 parts per 100 parts of the total quantity of the polyamide and light-polymerizable monomeric compound.

The photocurable coating composition is generally adjusted to a low viscosity of, for example, 10 to 400 cps (centi-poise), preferably 40 to 100 cps, at 25° C. by dissolving the above-mentioned components in a solvent for the polyamide, for example, a lower alcohol such as methanol, ethanol, propanol or butanol or a mixture thereof with 1 to 10% of water.

As described hereinbefore, the radiation-curable resin coating composition to be used in the present invention can be an electron beam-curable coating composition in place of the above-mentioned photocurable coating composition, which is readily obtained by removing the photopolymerization initiator from the above-mentioned phtocurable coating composition or reducing the quantity of the initiator.

In accordance with the present invention, the resulting radiation-curable coating composition is coated on the printing plate substrate comprising a metal such as copper, iron, chromium, nickel, stainless steel or aluminum or plastic, or a composite material obtained by forming a layer of an elastomer such as rubber on the surface of a core member of an arbitrary material. The shape of the printing plate substrate is not especially restricted, but a cylindrical shape as in conventional gravure rollers is preferably used. The coating of the composition can be carried out by optional methods such as spray coating, roll coating and curtain coating.

For coating on cylindrical substrates, the method disclosed in Japanese Patent Application No. 95734/1979 is preferably used. Thus, the coating composition is spirally applied as successively overlaid layers on the surface of a rotating cylindrical substrate, for example, by supplying the coating composition into a sump formed between the substrate and a coating composition retainer, such as a knife blade, disposed along and adjacent to the substrate and by causing the coating composition to flow from within the sump onto the surface of the substrate while causing the coating composition retainer to gradually leave the substrate. A dried coated film having a thickness of, for example, 50 to 500$\mu$ is formed either by drying the completely coated film or by repeating, at every revolution of the cylindrical substrate, the step of coating one layer and drying the coated layer at another position on the substrate. The drying is carried out, for example, by a non-draft heating dryer equipped with a far infrared rays-generating heater or the like.

The resulting dried resin-coated film is cured by irradiation with actinic rays such as ultraviolet rays or an electron beam. For the source of ultraviolet rays, a xenon lamp, a mercury lamp, a metal halide lamp, a chemical lamp, a carbon arc lamp, or the like is used. A high-pressure mercury lamp or chemical lamp having a peak at the wavelength of 365 m$\mu$ is preferably employed. For the source of an electron beam, either a beam-scanning type accelerator or a curtain-irradiation type accelerator provided with a linear filament can be used. In this connection, the irradiation with actinic rays may also be carried out on one coated layer after another after spiral or superimposed coating and drying thereof as the cylindrical substrate rotates, thereby to carry out successive curing.

After the above described curing step, the cured resin layer, if desired, is subjected to a heat treatment by holding the layer in an atmosphere of about 100° C., whereby the hardness of the resin layer is stabilized, and the engraving property of the layer is further enhanced.

As a result of the coating with a low-viscosity resin liquid, the resulting cured coated film is provided with a smoothness of approximately 1$\mu$ or less and preferably 0.5$\mu$ or less which is required for a gravure plate blank. If desired, a surface-smoothing treatment can be further applied by a paper polishing method, a buff polishing method, a machining method, or the like. In any case, an extremely small degree of the polishing or machining results in a smooth surface.

A gravure printing plate is then obtained by engraving, onto the resulting printing resin blank, gravure cells the size and depth of which are varied in accordance with local densities in the original image. The engraving is preferably carried out by using an electronic engraver such as Helio Klischograph manufactured by Dr.-Ing. Rudolf Hell GmbH, West Germany.

The cured coated films obtained as described above have ideal balance between engraving property and damage resistance as is represented by an ultimate elongation of 100% or less and a tensile strength of 100 Kg/cm$^2$ or more, and have almost no burrs or chips around the engraved cells. Thus, no deflashing operation using a burr cutter is required, which has been employed in the case of conventional electronic engraving.

The engraved gravure printing plate thus obtained is subjected to proof-printing and then to edition printing on a rotary printing press.

As described above, a gravure printing plate having excellent balance between engraving property and printing durability can be obtained in accordance with the present invention, wherein a radiation-curable resin coating composition containing a soluble polyamide and a radiation-polymerizable monomeric compound in a very restricted ratio together with a solvent is coated on a printing plate substrate, cured, and then engraved. The resulting resin gravure printing plate has resistance to a wide range of solvents such as isopropyl alcohol, ethyl acetate, toluene, and methyl ethyl ketone and also has such excellent printing durability that no scratch damage is produced by the use of solvent-type gravure inks and even by the use of steel doctor blades.

In order to indicate more fully the nature and utility of this invention, the following specific examples of practice thereof are set forth, it being understood that these examples are presented as illustrative only and are not intended to limit the scope of the invention.

EXAMPLE 1

With a solution of 0.02 part of methylhydroquinone dissolved in 10 parts of water, were mixed 74 parts of N,N'-dimethylolurea dimethyl ether, 202 parts of N-methylolacrylamide and 2 parts of ammonium chloride. The resulting mixture was caused to react by heating to 80° C. and stirring for 2 hours to obtain a condensate monomer or prepolymer.

In 932 g of methanol were dissolved 80 g of the resulting condensate prepolymer, 200 g of Ultramide 10 (a terpolymer of $\epsilon$-caprolactam, hexamethylene adipamide and 4,4'-diaminodicyclohexylmethane diadipamide) produced by BASF Aktien-gesellschaft, 6 g of benzophenone, and 16 g of triacryl formal (i.e., 1,3,5-triacryloylhexahydro-1,3,5-triazine), and then 39 g of water was added to the solution.

The photosensitive liquid composition thus obtained was coated on a copper-plated gravure cylinder at a velocity of 5 revolutions per minute by means of a knife-blade coating apparatus and then dried to obtain a smooth coated film 120 $\mu$m in thickness with a surface having neither undulations nor craters.

The resulting coated film, while rotating, was irradiated with ultraviolet rays from a 1.5-KW high-pressure mercury lamp for 20 minutes. The cured coated film was engraved by use of an electronic engraver with a diamond stylus (Helio Klischograph K-200 type produced by Hell GmbH) to obtain a gravure printing plate. It was noted that the engraving property of the cured film was good.

The resulting gravure printing plate was used for printing 110,000 impressions with a conventional steel doctor blade to produce satisfactory prints. There was almost no scratch damage due to the doctor blade on the used printing plate.

EXAMPLE 2

Five photocurable resin coating compositions were prepared by changing only the quantities of the condensate monomer used in Example 1, which is a photopolymerizable monomeric compound. These resin coating compositions were formed into 1.0 mm thick sheets, which were then irradiated for 5 minutes with a 1.5-KW high-pressure mercury lamp to obtain cured sheets, after which the physical properties thereof were measured. These resin coating compositions were also coated on cylinders and then engraved in the same way as in Example 1. Then the properties thereof such as the engraving property were determined. The results are shown in the following table.

| Run No. | Quantity of condensate monomer (parts/100 parts of polyamide) | Ultimate tensile elongation (%) | Ultimate tensile strength (Kg · f/cm$^2$) | Engraving property | Damage resistance |
|---|---|---|---|---|---|
| 1 | 28 | 124.5 | 241 | X | ◎ |
| 2 | 48 | 80.1 | 224 | ∘ | ◎ |
| 3 | 58 | 58.7 | 219 | ◎ | ◎ |
| 4 | 68 | 32.6 | 198 | ◎ | ◎ |
| 5 | 88 | 4.8 | 123 | ◎ | ∘ |
| 6 | 108 | 2.9 | 67.5 | ◎ | ∘ |
| 7 | 128 | Approximately 0 | 48 | ◎ | X |

The methods and standards for evaluation with respect to the test items were as follows.

Ultimate tensile elongation

JIS (Japanese Industrial Standards) K6301.

Ultimate tensile strength

JIS K6301.

Engraving property

Engraving was carried out by an electronic engraver (Helio Klischograph K200 type produced by Hell GmbH, West Germany), wherein the pitch was set at 70 lines/cm and cell configuration at compression type.

X: burrs produced on the entire surface.

∘: some burrs produced partly.

◎: no burr produced.

Damage resistance

The cured resins were scratched intentionally under the following test conditions, and the scratch depths were measured and evaluated by means of a surface-roughness meter.

| | |
|---|---|
| [Conditions] | |
| (1) stylus point: | 90° triangular pyramid stylus (diamond) |
| (2) Load: | 100 g |
| (3) Stylus traveling speed: | 100 mm/min. |
| [Evaluation standard] | |
| X: scratch depth of 3μ or more | |
| ∘: scratch depth of less than 3μ | |
| ◎: scratch depth of 1μ or less | |

EXAMPLE 3

A photosensitive coating composition was prepared by stirring the following components at 75° C. in a flask with a stirrer placed in a water bath.

| | |
|---|---|
| Toresin F-30 (produced by Teikoku Kagaku Sangyo K. K., Japan, methoxymethylated 6-nylon) | 800 g |
| triacryl formal | 128 g |
| N,N'-(m-phenylene)bisacrylamide | 300 g |
| benzophenone | 32 g |

-continued

| | |
|---|---|
| Suminol millingcyanin 5R extra (trade name, produced by Sumitomo Kagakusha, Japan) | 4 g |
| solvent (methanol) | 3708 g |
| water | 174.8 g |

The above-obtained resin liquid was diluted with methanol to a viscosity of 50 cps at 25° C. and then coated on a metal cylinder of 660 mm in circumference and 700 mm in length which was contacted by a knife blade while the metal cylinder was uniformly rotated at 3 r.p.m. with heating by a drying apparatus, and the blade was gradually separated away from the cylinder. A coated film of 150μ in thickness of excellent smoothness was obtained after coating for about 15 minutes. The coated film was cured by irradiation of the whole surface thereof for about 15 minutes by a 2.1-KW high-pressure mercury lamp.

The resulting resinous cylinder was engraved with an electronic engraver (Helio Klischograph K200).

In the engraving, the pitch was set at 70 lines/cm, and the cell sizes of high-light areas and shadow areas were adjusted to be the same as those when a conventional copper cylinder was engraved. Engraving was then carried out without using a burr cutter.

Neither burrs nor chips were found in the engraved cells. The engraved cylinder was subjected to proof printing without further processing. It was noted that it had a good tone-reproducible quality.

The engraved cylinder was then mounted in a rotary gravure printing press, and printing was carried out on paper by using a steel doctor blade (Vickers hardness 550°) and a mixed solvent-based gravure ink containing toluene, ethyl acetate and isopropyl alcohol. Even after a printing of a length of 400,000 meters, no doctor damage was produced, and no problem whatsoever occurred.

What is claimed is:

1. A process for producing resinous gravure printing plates which comprises coating a printing substrate with a film of a radiation-curable coating composition comprising 100 parts by weight of a soluble polyamide resin, 50 to 100 parts by weight of a radiation-polymerizable monomeric compound, and a solvent in a quantity sufficient to cause the viscosity of the coating composition to be suitable for coating, curing the coated film by irradiation with actinic rays, and engraving the resulting cured coated film, said radiation-polymerizable monomeric compound being a nitrogen-containing compound having at least three ethylenic unsaturations.

2. The process according to claim 1, in which: the coating composition further comprises a photopolymerization initiator in a quantity of 0.01 to 10% by weight with respect to the total quantity of the polyamide resin and the radiation-polymerizable monomeric compound; the coating composition is photocurable; and the actinic rays are ultraviolet rays.

3. The process according to claim 1, in which the coating composition has a viscosity of 10 to 400 cps when it is coated on the substrate.

4. The process according to claim 1, in which the printing substrate is of a cylindrical shape.

5. The process according to claim 8, in which the coating composition is spirally applied as successively overlaid layers on the surface of the cylindrical substrate, as the substrate is rotated.

6. The process according to claim 5, in which the spiral application of the coating composition is carried out by supplying the coating composition into a sump formed between the substrate and a coating composition retainer disposed along and adjacent to the substrate and by causing the coating composition to flow from within the sump onto the surface of the substrate while causing the coating composition retainer to gradually leave the substrate.

7. The process according to claim 1, in which the coated film is dried prior to the irradiation.

8. The process according to claim 1, in which the engraving is carried out by an electronic engraver.

9. The process according to claim 1, in which the coated film is irradiated for a time sufficient to produce a coated cured film having an ultimate tensile elongation of 100% or less and a tensile strength of 100 $Kg/cm^2$ or more.

* * * * *